US007220167B2

(12) United States Patent
Feng et al.

(10) Patent No.: US 7,220,167 B2
(45) Date of Patent: May 22, 2007

(54) GENTLE CHEMICAL MECHANICAL POLISHING (CMP) LIFTOFF PROCESS

(75) Inventors: Jian-Huei Feng, San Jose, CA (US); Hung-Chin Guthrie, Santa Clara, CA (US); Ming Jiang, San Jose, CA (US); John Jaekoyun Yang, Newark, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 0 days.

(21) Appl. No.: 11/034,340

(22) Filed: Jan. 11, 2005

(65) Prior Publication Data

US 2006/0154573 A1 Jul. 13, 2006

(51) Int. Cl.
*B24B 1/00* (2006.01)

(52) U.S. Cl. ..... 451/41; 451/59

(58) Field of Classification Search ..... 451/5, 451/41, 59; 360/120; 438/692–693, 712; 29/603.14, 603.15

See application file for complete search history.

(56) References Cited

U.S. PATENT DOCUMENTS 3,594,220 A * 7/1971 Schwacke et al. ..... 442/77
3,912,840 A * 10/1975 Edberg ..... 428/85
5,538,465 A 7/1996 Netsu et al. ..... 451/397
5,645,474 A 7/1997 Kubo et al. ..... 451/287
6,241,578 B1 6/2001 Togawa et al. ..... 451/5
6,290,580 B1 * 9/2001 Tanaka et al. ..... 451/44
6,300,249 B1 10/2001 Yoshida et al. ..... 438/693
6,306,021 B1 10/2001 Masumura et al. ..... 451/287
6,821,187 B2 * 11/2004 Beitel et al. ..... 451/5
6,899,598 B2 * 5/2005 Prasad ..... 451/41
2002/0031990 A1 3/2002 Masumura et al. ..... 451/287
2003/0110803 A1 6/2003 Saito et al. ..... 65/30.14
2003/0153251 A1 8/2003 Mizushima ..... 451/44
2004/0055223 A1 3/2004 Ono et al. ..... 51/293
2005/0032248 A1 * 2/2005 Cyrille et al. ..... 438/3
2005/0101227 A1 * 5/2005 Balijepalli et al. ..... 451/41
2005/0178742 A1 * 8/2005 Chelle et al. ..... 216/88

* cited by examiner

*Primary Examiner*—Jacob K. Ackun, Jr.
(74) *Attorney, Agent, or Firm*—Zilka-Kotab, PC

(57) ABSTRACT

A method for chemical mechanical polishing (CMP) wafers having high aspect ratio surface topography. A wafer is positioned on a plate. A polishing pad is coupled to a platen. A polishing solution (e.g., slurry) is added between the polishing pad and the wafer. CMP is performed on the wafer by creating a relative movement between the polishing pad and the wafer. The polishing pad removes substantially all residual material from the channels. To accomplish this, the polishing pad has a compressibility of at least 5% at a polishing pressure of about 4 psi.

25 Claims, 5 Drawing Sheets

GENTLE CHEMICAL MECHANICAL POLISHING (CMP) LIFTOFF PROCESS

FIELD OF THE INVENTION

The present invention relates to semiconductor processing, and more particularly, this invention relates to a gentle CMP liftoff process suitable for high aspect ratio sensor track width definition.

BACKGROUND OF THE INVENTION

Semiconductor processing typically includes several Chemical Mechanical Polishing (CMP) steps. CMP combines the chemical removal effect of an acidic or basic fluid solution with the "mechanical" effect provided by polishing with an abrasive material. The CMP system usually has a polishing "head" that presses the rotating wafer against a flexible pad. A wet chemical slurry containing a micro-abrasive is placed between the wafer and pad.

CMP removes material from uneven topography on a wafer surface until a flat (planarized) surface is created. This allows subsequent photolithography to take place with greater accuracy, and enables film layers to be built up with minimal height variations.

A new CMP application has been introduced recently where CMP is used to clean up fencing and resist remaining from prior processing steps. For example, in disk head fabrication, a CMP liftoff process with $SiO_2$ slurry and standard hard polishing pad is implemented for sensor track width definition. However, this process is reaching the end of its process capability as sensor track width continues to shrink. Current CMP processes cannot completely remove fencing and/or resist in the critical track width due to the topography formed by resist becoming thinner and narrower. Current process of record (POR) CMP liftoff process have been found to not effectively remove lead shorting and fencing, and cause lead resistance variation and sensor instability for narrow track products.

The known polishing pads for the mirror surface of a semiconductor wafer used in CMP include a polishing pad of polyurethane foam type, a polishing pad of polishing cloth type having a polyester nonwoven fabric impregnated with polyurethane resin, and a polishing pad of stacked type having the above two pads laminated therein.

For the polishing pad of polyurethane foam type, a polyurethane foam sheet having a void volume of about 30 to about 35% is typically used. A polishing pad comprising fine hollow particles or water-soluble polymer particles dispersed in a matrix resin such as polyurethane are also known.

Among these polishing pads are those formed with grooves or holes on the surface of their polishing layer for the purpose of improving the fluidity of slurry and maintaining the slurry.

The known polyurethane foam sheet having a void volume of about 30 to about 35% as described above is excellent in a local planarization, but exhibits low compressibility, i.e., on the order of about 0.5 to about 1.0% and is thus poor in cushioning characteristics, making it difficult to exert uniform pressure onto the whole surface of a wafer. Accordingly, CMP processing is carried out usually after the backside of a polyurethane foam sheet is provided separately with a soft cushion layer.

However, none of the above-mentioned polishing pads have been able to provide satisfactory removal of resist and fencing from the high aspect ratio channel formed between sensor leads adjacent the sensor track width. The following discussion describes the problem in more detail.

FIG. 1 is a top down view of a wafer 100 of magnetoresistance (MR) sensors. The track width (W) of the sensor is defined between the leads 102, 104. CMP dislodges particles 106 of resist and fencing. These particles 106 can lodge in between the leads 102, 104, causing a short. However, CMP with standard hard pads cannot always remove particles from between the leads 102, 104. If the particle cannot be removed, the short causes the device to fail. Additionally, as shown in FIG. 2, traditional CMP tends to remove the edges of the leads, causing a reduction in the overall cross sectional area of the lead. This in turn causes an increase in the resistance of the lead, and resultant loss of sensitivity of the MR sensor. Further, as shown in the microscopy scan of a representative MR sensor (FIG. 3), which corresponds generally to the cross sectional view shown in FIG. 2, traditional CMP cannot completely remove fencing 300. A fence next to the sensor affects sensor performance by creating an electrical short between the sensor and the shield and also by changing the gap and shield coverage profile above the sensor.

What is needed is a way to perform CMP which reduces or avoids these adverse effects.

SUMMARY OF THE INVENTION

The present invention overcomes the drawbacks and limitations described above by providing a method for chemical mechanical polishing (CMP). The method is particularly adapted to wafers having high aspect ratio surface topography, such as wafer having magnetoresistance (MR) sensors formed thereon, the MR sensors having leads and a channel defined between the leads. To perform the CMP, a wafer is positioned on a plate. A polishing pad is coupled to a platen. A polishing solution (e.g., slurry) is added between the polishing pad and the wafer. CMP is performed on the wafer by creating a relative movement between the polishing pad and the wafer.

The polishing pad removes substantially all residual material from the channels. To accomplish this, the polishing pad is softer than those heretofore implemented. Particularly, the polishing pad has a compressibility of at least 5% at a polishing pressure of about 4 psi. Preferably, the polishing pad has a compressibility of about 8% or more at a polishing pressure of about 4 psi. Ideally, the polishing pad has a compressibility of between about 8% and about 12% at a polishing pressure of about 4 psi.

In one embodiment, the polishing pad includes a layer of microporous synthetic leather. In another embodiment, the polishing pad includes a layer of cloth. In yet another embodiment, the polishing pad includes a layer of suede.

The new soft pad CMP process works well for removing debris from high aspect ratio topography. For instance, the inventive CMP process has been found effective to remove fencing and shorts where the widths of the channels between the adjacent leads are less than thicknesses of the channels as defined perpendicular to an overall plane of the wafer, even where widths of the channels between the adjacent leads are less than one half the thicknesses of the channels.

The new soft pad CMP process also works well even as the thickness of the leads increases by more than ~40%, e.g., from 250 Å to 350 Å and beyond as measured in a direction perpendicular to the wafer surface.

Other aspects and advantages of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

BEST MODE FOR CARRYING OUT THE INVENTION

The following description is the best embodiment presently contemplated for carrying out the present invention. This description is made for the purpose of illustrating the general principles of the present invention and is not meant to limit the inventive concepts claimed herein.

Figure 4:
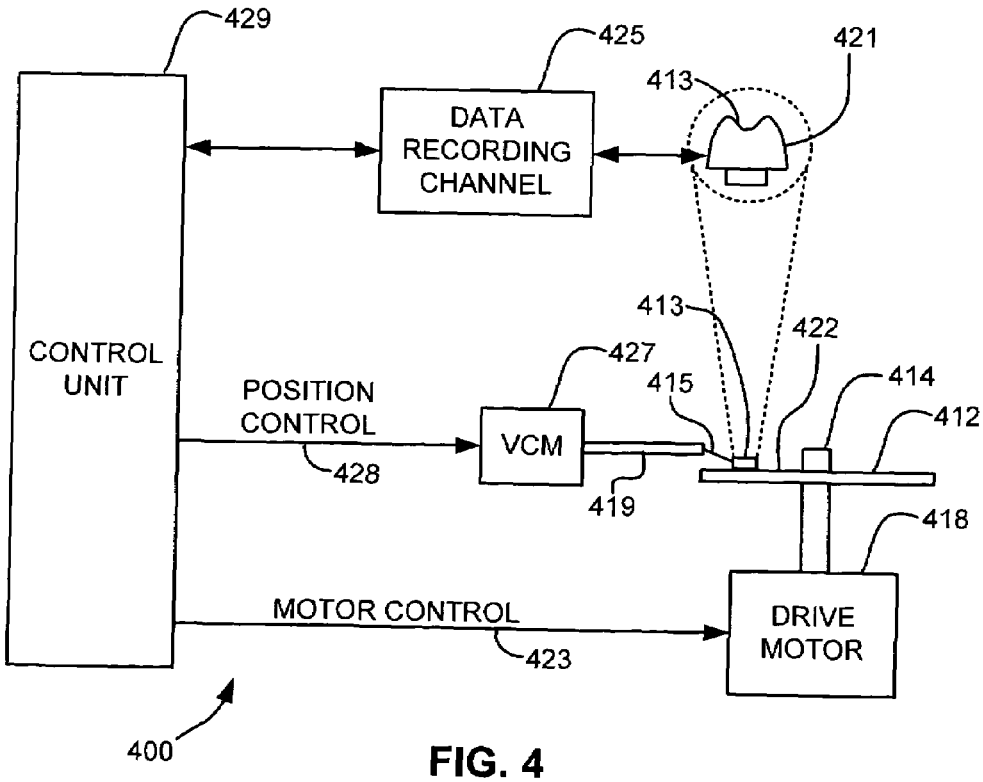
FIG. 4 is a simplified drawing of a magnetic recording disk drive system.

Referring now to FIG. 4, there is shown a disk drive 400 embodying the present invention. As shown in FIG. 4, at least one rotatable magnetic disk 412 is supported on a spindle 414 and rotated by a disk drive motor 418. The magnetic recording on each disk is in the form of an annular pattern of concentric data tracks (not shown) on the disk 412.

At least one slider 413 is positioned near the disk 412, each slider 413 supporting one or more magnetic read/write heads 421. Each read/write head includes a magnetoresistance (MR) sensor. As the disks rotate, slider 413 is moved radially in and out over disk surface 422 so that heads 421 may access different tracks of the disk where desired data are recorded. Each slider 413 is attached to an actuator arm 419 by means of a suspension 415. The suspension 415 provides a slight spring force which biases slider 413 against the disk surface 422. Each actuator arm 419 is attached to an actuator means 427. The actuator means 427 as shown in FIG. 4 may be a voice coil motor (VCM). The VCM comprises a coil movable within a fixed magnetic field, the direction and speed of the coil movements being controlled by the motor current signals supplied by controller 429.

During operation of the disk storage system, the rotation of disk 412 generates an air bearing between slider 413 and disk surface 422 which exerts an upward force or lift on the slider. The air bearing thus counter-balances the slight spring force of suspension 415 and supports slider 413 off and slightly above the disk surface by a small, substantially constant spacing during normal operation.

The various components of the disk storage system are controlled in operation by control signals generated by control unit 429, such as access control signals and internal clock signals. Typically, control unit 429 comprises logic control circuits, storage means and a microprocessor. The control unit 429 generates control signals to control various system operations such as drive motor control signals on line 423 and head position and seek control signals on line 428. The control signals on line 428 provide the desired current profiles to optimally move and position slider 413 to the desired data track on disk 412. Read and write signals are communicated to and from read/write heads 421 by way of recording channel 425.

The above description of a typical magnetic disk storage system, and the accompanying illustration of FIG. 4 are for representation purposes only. It should be apparent that disk storage systems may contain a large number of disks and actuators, and each actuator may support a number of sliders.

In one illustrative process for MR sensor fabrication, a MR sensor is formed by creating several stacks of magnetic and nonmagnetic materials. A resist mask is formed above the stack to define the track width and the structure is milled to remove exposed regions of the stack outside the track width. Leads are formed on opposite sides of the MR sensor. Then the resist mask and fencing adjacent the resist are removed via solvent liftoff process and more recently CMP processing. Note that the CMP process can involve two separate CMP steps: one to planarize the structure and remove the bulk of the resist, and one to clean up the structure. In a two step CMP process, the present invention is particularly applicable to the clean up CMP.

As mentioned above, heretoforeknown POR CMP liftoff processes for read head sensor track width definition have been found to not effectively remove lead shorting and fencing, and also cause lead resistance variation and sensor instability for narrow track products.

To improve the process capability for better fencing removal and better resist removal for narrow track products, a gentle CMP liftoff process with soft polishing pad has been developed and is presented herein. The soft pad gentle CMP conforms to the topography of the structure more easily and therefore exhibits improved removal of resist and fencing in the track area, as well as removing debris from the trench between the leads.

Figure 5:
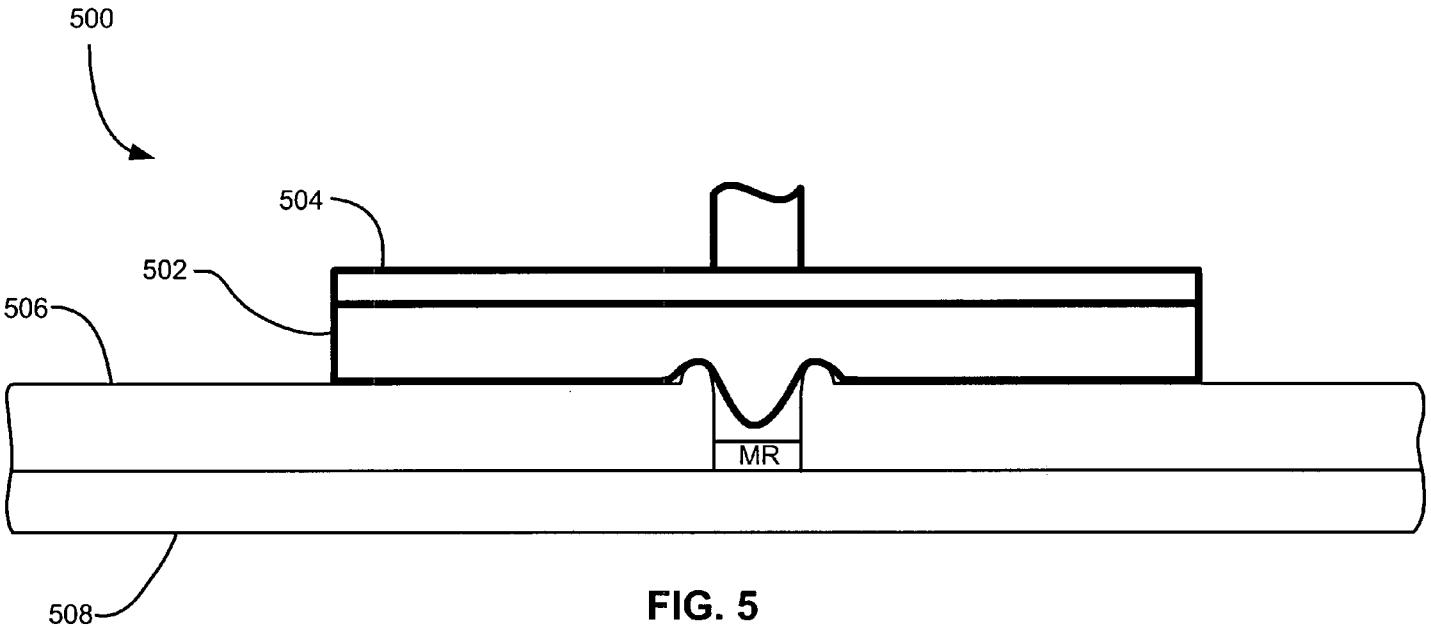
FIG. 5 is a simplified drawing of a system for performing CMP.

FIG. 5 shows a system 500 for performing CMP according to one embodiment. Generally during CMP, a polishing pad 502 is coupled to a rotatable supporting plate 504 called a platen, while a semiconductor wafer 506 having several MR sensors defined thereon is held on a plate 508 called a polishing head capable of self-rotation. By rotational movement of the two, a relative speed is generated between the platen 504 and the polishing head 508, and while a solution (slurry) having very fine silica- or ceria-based particles (abrasive grains) suspended in an alkali solution or in an acidic solution is allowed to flow through a gap between the polishing pad 502 and the wafer 506, to effect a gentle polishing and cleanup process. When the polishing pad 502 moves relative to the surface of the wafer 506, abrasive grains are pushed at contact points against the surface of the wafer 506. Accordingly, the surface of the wafer 506 is gently polished by the sliding dynamic frictional action between the surface of the wafer 506 and the abrasive grains, to reduce the unevenness and surface roughness of the wafer 506. The soft polishing pad 502 deforms to enter the spaces formed between the topographical features found on the surface of the wafer 506, thereby removing any debris found in those spaces.

Figure 1:
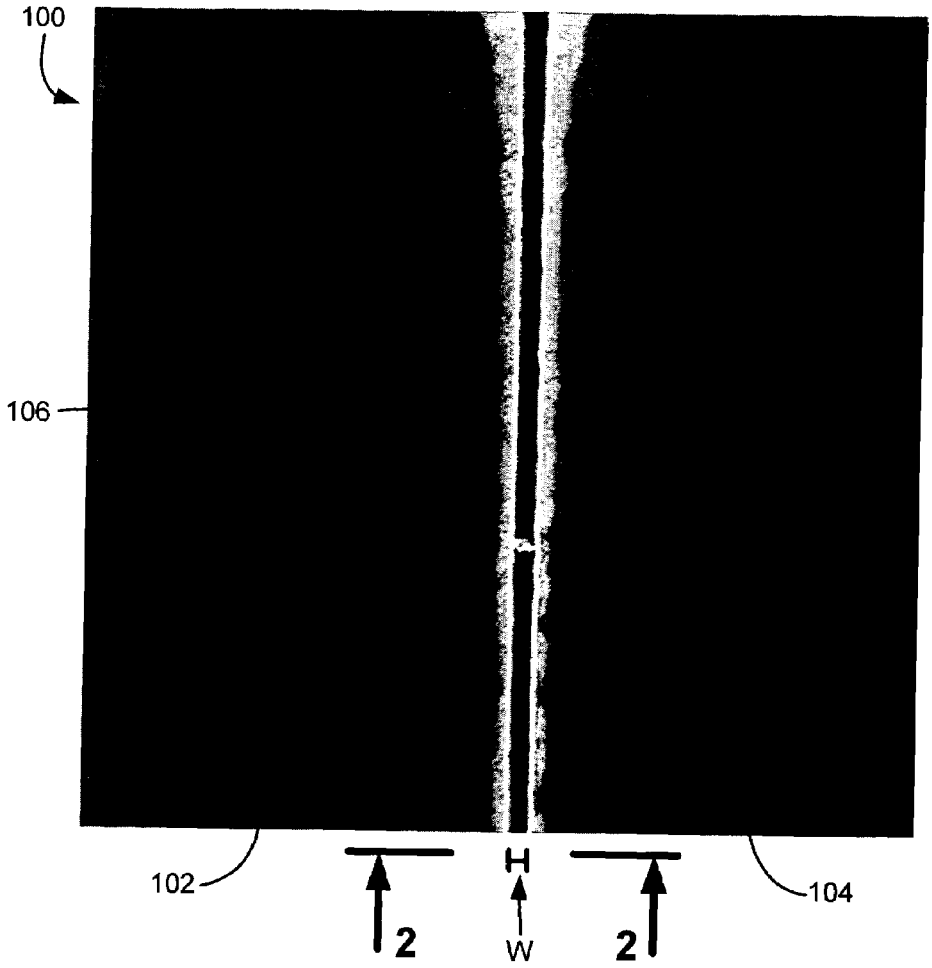
FIG. 1 (PRIOR ART)
FIG. 1 is top down view of a MR sensor after traditional CMP.
Figure 6:
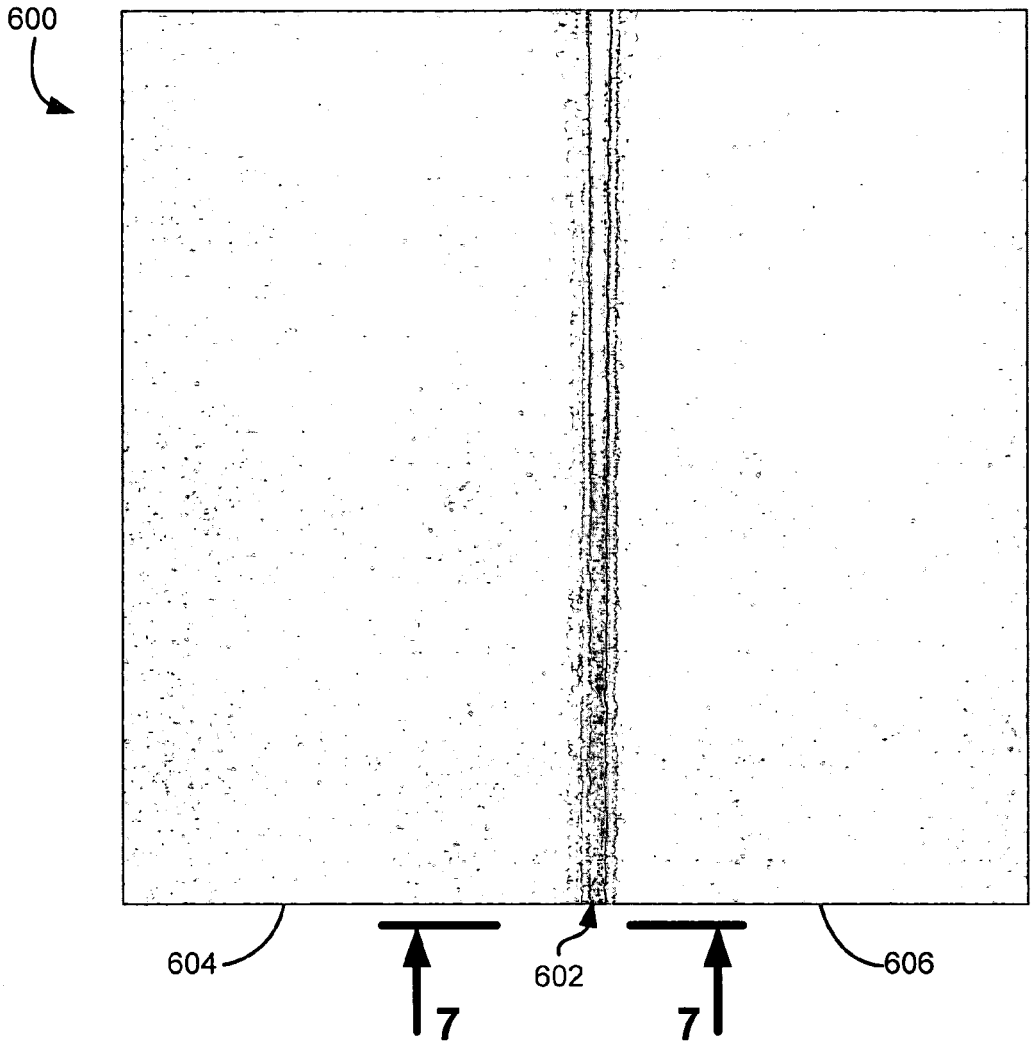
FIG. 6 is a top down view of a wafer of magnetoresistance (MR) sensors after the CMP of the present invention.

FIG. 6 is a top down view of a wafer 600 of magnetoresistance (MR) sensors after the CMP of the present invention. As shown, though the channel 602 (track width) between the leads 604, 606 is very small, no shorts are formed between the leads 604, 606. Upon comparison of FIG. 6 with the wafer 100 shown in FIG. 1, on which a short was formed by the prior art CMP, it can be seen that the CMP process disclosed herein is far superior to the prior art CMP process.

Figure 2:
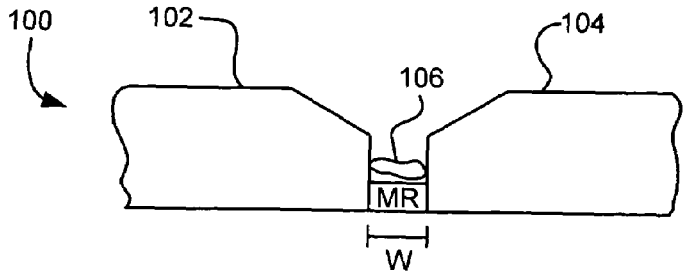
FIG. 2 (PRIOR ART)
FIG. 2 is a partial cross sectional view, not to scale, of the MR sensor of FIG. 1 taken along plane 2—2 of FIG. 1.
Figure 7:
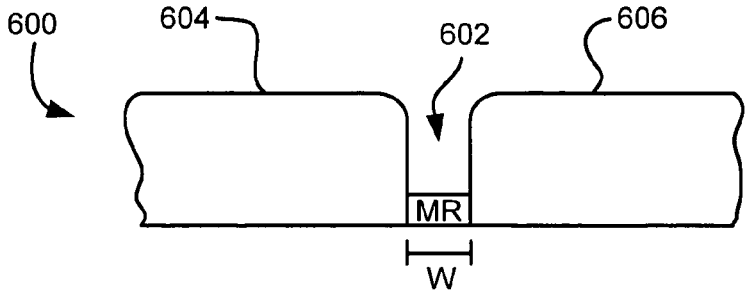
FIG. 7 is a partial cross sectional view, not to scale, of the MR sensor of FIG. 6 taken along plane 7—7 of FIG. 6.

The polishing rate from this new soft pad gentle CMP is slightly higher than hard pad processes, but lead resistance is less sensitive to polishing due to less lead cross area reduction or damage. In other words, the inventive CMP process using the soft polishing pad does not significantly reduce the cross sectional area of the leads adjacent the track width. Rather, as shown in FIG. 7, the gentle CMP process effectively removes the shoulders without significantly affecting the bulk of the leads. The comers of the leads 604, 606 adjacent the channel 602 tend to be rounded, but remain relatively intact. This means that the resistance of the leads does not increase as much as it would if prior art CMP were performed. The distinction is best seen when comparing FIG. 7 with prior art FIG. 2. The net result is that the overall sensor performance is maintained, as the sensor function depends on reading variations in the sensing signal.

Figure 8:
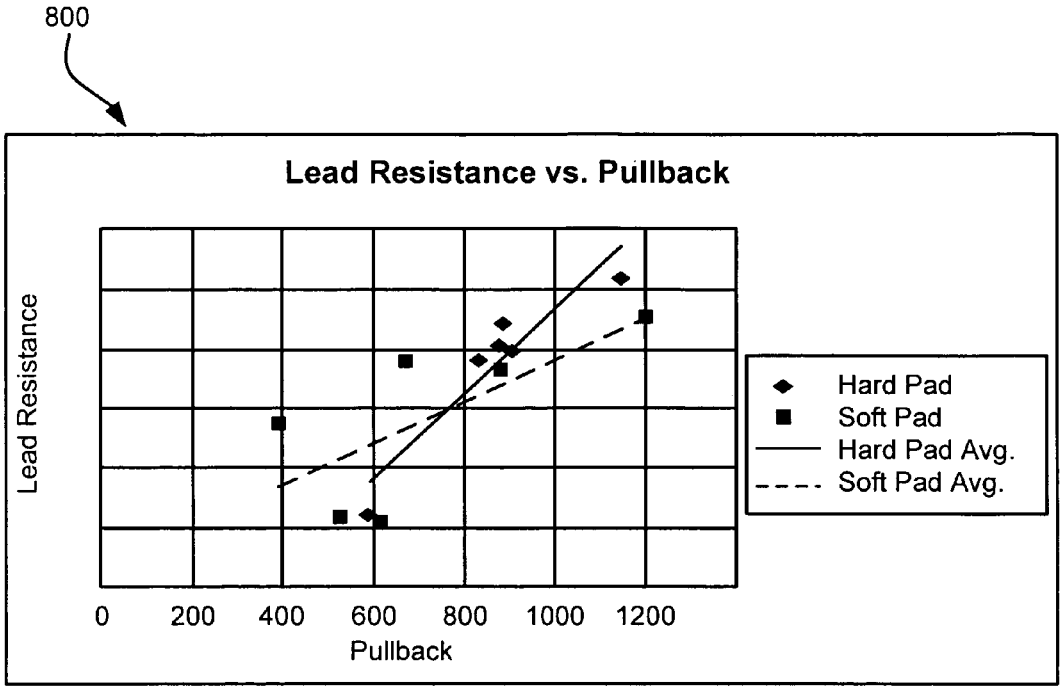
FIG. 8 is a chart depicting lead resistance vs. lead pull-back

FIG. 8 shows another comparison of the new gentle CMP process to traditional CMP on a wafer of MR sensors. The chart 800 of FIG. 8 shows the lead resistance vs. lead pullback, where pullback is the amount of material removed from the leads at the edge of the track width. As shown, the lead resistance of the wafer polished with the traditional hard pad tends to increase with pullback at a much higher rate than when polished with the soft polishing pad.

Experiments performed by the inventors concluded that residual resist and fence become more problematic as lead thickness increases by more than ~40%, e.g., from 250 Å to 350 Å or more, and as the MR track width decreases. However, the new soft pad gentle CMP process clearly showed improvements in resist and fence removal capability as well as center-to-edge uniformity across such lead thicknesses.

The soft polishing pad used in the present invention preferably includes a backside layer, a polishing layer that engages the wafer, and optional intermediate layers if desired. The backside layer provides support to the polishing layer, and can be formed of a rigid plastic that is attachable to a platen. The polishing layer is soft enough to enter voids in the topography of the wafer. Particularly, the polishing layer is capable of removing substantially all of the resist found in the high aspect ratio channel formed between the leads at the track width. By high aspect ratio, what is meant is that the width of the channels between the adjacent leads are less than the heights of the channels as defined perpendicular to the overall plane of the wafer. For instance, the width of the channels can be less than one half the height of the channels.

The compressibility of the polishing pad is much higher than the currently-implemented POR polymer urethane hard pad. Preferably, the compressibility of the polishing pad is greater than 5% at a polishing pressure of 4 pounds per square inch (psi) in consideration of the polishing layer, backside layer, and any intermediate layers. It is more preferably in the range of about 8 to about 12% at a polishing pressure of 4 psi. The compression recovery of the polishing layer is preferably 50% or more in consideration of the cushioning characteristics of the polishing layer.

The polishing layer of the polishing pad according to a preferred embodiment is microporous synthetic leather made of a suitable material, e.g., polyurethane. Its compressibility in conjunction with a semirigid backside layer falls within the desired range. Other suitable materials for the polishing layer include cloth, suede, and any other material providing compressibility in the desired range. Note that a soft intermediate layer may be required to provide the desired overall compressibility.

The polishing layer can be foamed by mechanical foaming or chemical foaming to improve its elastic modulus. In one embodiment, the surface of the polishing layer is formed with grooves through which slurry used in polishing flows. In another embodiment, the surface of the polishing layer is formed with grooves in which slurry used in polishing is stored.

Figure 9:
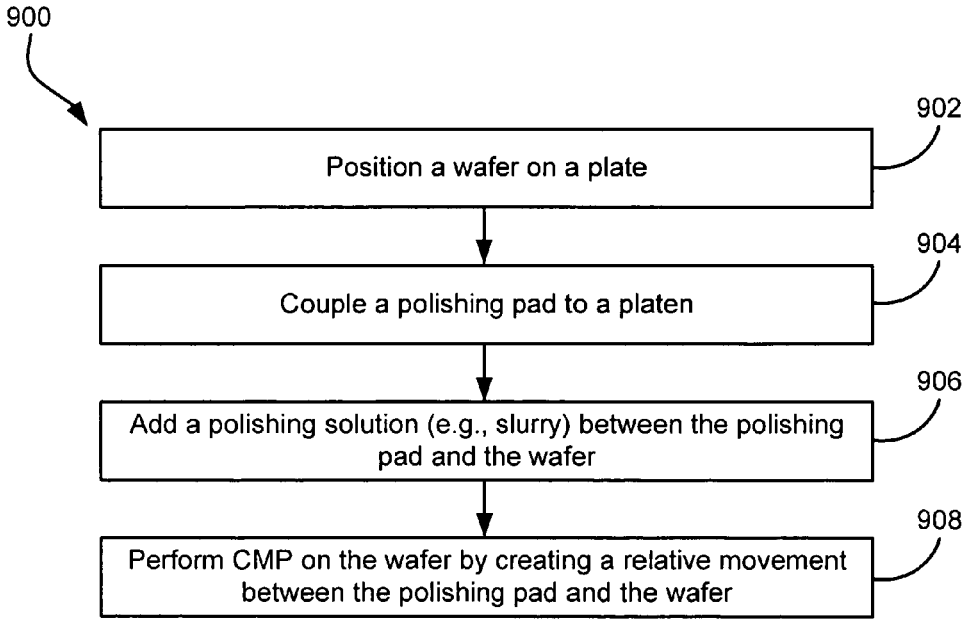
FIG. 9 is a flow diagram depicting a method for CMP processing of a wafer having magnetoresistance (MR) sensors formed thereon.

FIG. 9 illustrates a method 900 for CMP processing of a wafer having magnetoresistance (MR) sensors formed thereon, the MR sensors having leads and a channel defined between the leads. (See FIG. 6.) In operation 902, a wafer is positioned on a plate. In operation 904, a polishing pad is coupled to a platen. A polishing solution (e.g., slurry) is added between the polishing pad and the wafer in operation 906. The slurry is a conventional slurry. One practicing the invention should keep in mind that the slurry selection should include consideration of the materials in the wafer. For instance, acidic or oxidative slurries should not be used on exposed metallic layers.

In operation 908, CMP is performed on the wafer by creating a relative movement between the polishing pad and the wafer. The polishing pad removes substantially all residual material from the channels during the CMP step.

The CMP is preferably performed at a force of about 4 to about 6 psi exerted on the polishing pad. The polishing time can vary from about 30 to about 120 seconds. One skilled in the art will appreciate that the processing parameters will vary depending on the materials used in the pad, slurry and the material being polished. When selecting the parameters, one practicing the invention should keep in mind that longer processing is more likely to remove any lead shorts, but also that lead polishing increases with polishing time.

Figure 3:
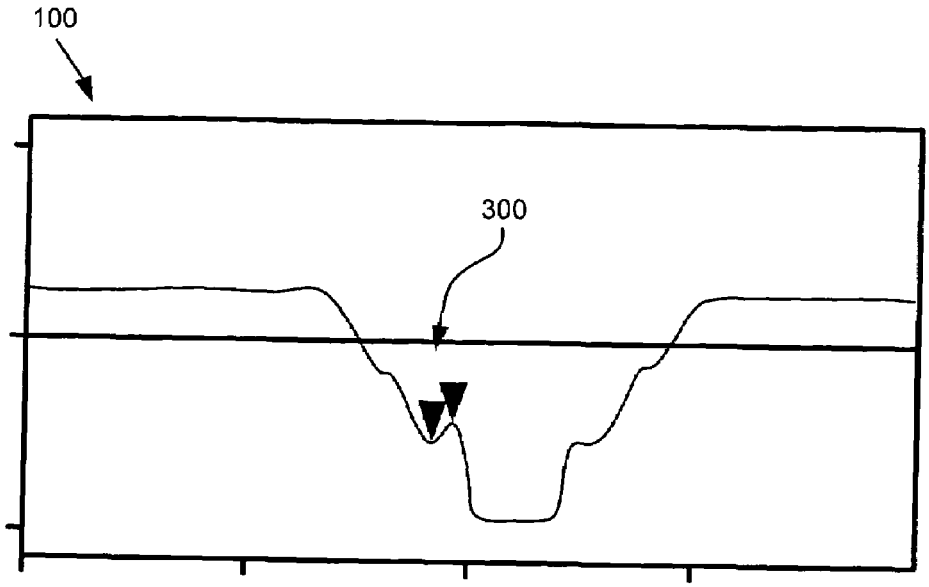
FIG. 3 (PRIOR ART)
FIG. 3 is a microscopy scan result of a representative MR sensor depicting fencing created by prior art CMP.

When tuning the processing parameters, optical image capture (e.g., FIG. 6) can be used to verify that no lead shorts are present. Similarly, AFM (e.g., FIG. 3) can be used to determine whether any fencing is present. Once the parameters are tuned, the system can be automated.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method for chemical mechanical polishing, comprising:

placing a polishing solution on a wafer having channels defined therein; and performing a chemical mechanical polishing on the wafer using a polishing pad having a compressibility of at least 5% at a polishing pressure of about 4 psi, the polishing pad removing substantially all residual material from the channels.

2. A method as recited in claim 1, wherein the polishing pad has a compressibility of about 8% or more at a polishing pressure of about 4 psi.

3. A method as recited in claim 1, wherein the polishing pad has a compressibility of between about 8% and about 12% at a polishing pressure of about 4 psi.

4. A method as recited in claim 1, wherein the polishing pad includes a layer of microporous synthetic leather.

5. A method as recited in claim 1, wherein the polishing pad includes a layer of cloth.

6. A method as recited in claim 1, wherein the polishing pad includes a layer of suede.

7. A method as recited in claim 1, wherein the channels are defined between leads of magnetoresistance sensors.

8. A method as recited in claim 7, wherein a thickness of the leads are at least 350 Å as measured in a direction perpendicular to the wafer surface.

9. A method as recited in claim 7, wherein a thickness of the leads are at least 350 Å as measured in a direction perpendicular to the water surface.

10. A method as recited in claim 7, wherein widths of the channels between the adjacent leads are less than heights of the channels defined perpendicular to an overall plane of the wafer.

11. A method as recited in claim 10, wherein widths of the channels between the adjacent leads are less than one half the heights of the channels defined perpendicular to an overall plane of the wafer.

12. A method as recited in claim 1, wherein the method is used during fabrication of a magnetoresistance sensor.

13. A method for chemical mechanical polishing, comprising:

positioning a wafer on a plate;

wherein the wafer has magnetoresistance (MR) sensors formed thereon, the MR sensors having leads and a channel defined between the leads;

coupling a polishing pad to a platen;

placing a polishing solution between the polishing pad and the wafer; and performing a chemical mechanical polishing on the wafer by creating a relative movement between the polishing pad and the wafer;

wherein the polishing pad has a compressibility of at least 5% at a polishing pressure of about 4 psi. The polishing pad removing substantially all residual material from the channels.

14. A method as recited in claim 13, wherein the polishing pad has a compressibility of about 8% or more at a polishing pressure of about 4 psi.

15. A method as recited in claim 13, wherein the polishing pad has a compressibility of between about 8% and about 12% at a polishing pressure of about 4 psi.

16. A method as recited in claim 13, wherein the polishing pad includes a layer of microporous synthetic leather.

17. A method as recited in claim 13, wherein the polishing pad includes a layer of cloth.

18. A method as recited in claim 13, wherein the polishing pad includes a layer of suede.

19. A method as recited in claim 13, wherein the channels correspond to track widths of the MR sensors.

20. A method as recited in claim 13, wherein a thickness of the leads are at least 250 Å as measured in a direction perpendicular to the wafer surface.

21. A method as recited in claim 13, wherein a thickness of the leads are at least 350 Å as measured in a direction perpendicular to the wafer surface.

22. A method as recited in claim 13, wherein widths of the channels between the adjacent leads are less than heights of the channels defined perpendicular to an overall plane of the wafer.

23. A method as recited in claim 22, wherein widths of the channels between the adjacent leads are less than one half the heights of the channels defined perpendicular to an overall plane of the wafer.

24. A method as recited in claim 13, wherein the method is used during fabrication of an MR sensor.

25. A method for chemical mechanical polishing, comprising:

positioning a wafer on a plate;

wherein the wafer has magnetoresistance (MR) sensors formed thereon, wherein the MR sensors having leads and a channel defined between the leads;

coupling a polishing pad to a platen, wherein the polishing pad includes synthetic leather;

wherein the polishing pad has a compressibility of about 8% or more at a polishing pressure of about 4 psi;

placing a polishing solution between the polishing pad and the wafer;

performing a chemical mechanical polishing on the wafer by creating a relative movement between the polishing pad and the wafer, the polishing pad removing substantially all residual material from the channels;

wherein a thickness of the leads are at least 250 Å as measured in a direction perpendicular to the wafer surface, wherein widths of the channels between the adjacent leads are less than heights of the channels defined perpendicular to an overall plane of the wafer.

* * * * *

UNITED STATES PATENT AND TRADEMARK OFFICE

CERTIFICATE OF CORRECTION

PATENT NO. : 7,220,167 B2
APPLICATION NO. : 11/034340
DATED : May 22, 2007
INVENTOR(S) : Feng et al.

It is certified that error appears in the above-identified patent and that said Letters Patent is hereby corrected as shown below:

col. 7, line 16 change “350” to --250--;
col. 7, line 20 change “water” to --wafer--;
col. 7, line 44 change “4 psi. The” to --4 psi, the--.

Signed and Sealed this

Third Day of July, 2007

JON W. DUDAS
*Director of the United States Patent and Trademark Office*